US006812627B2

(12) United States Patent
Chun et al.

(10) Patent No.: US 6,812,627 B2
(45) Date of Patent: Nov. 2, 2004

(54) CATHODE RAY TUBE HAVING MASK ASSEMBLY FOR DISPLAYING CLEARER IMAGES

(75) Inventors: Sang-Ho Chun, Seongnam (KR); Jun-Jong Lee, Seoul (KR); Hyang-Jin Ko, Suwon (KR); Jong-Han Lee, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 122 days.

(21) Appl. No.: 10/077,761

(22) Filed: Feb. 20, 2002

(65) Prior Publication Data

US 2002/0117955 A1 Aug. 29, 2002

(30) Foreign Application Priority Data

Feb. 27, 2001 (KR) ..... 2001-9897

(51) Int. Cl.[7] ..... H01J 29/80
(52) U.S. Cl. ..... 313/402; 313/408
(58) Field of Search ..... 313/402–408, 313/461, 409

(56) References Cited

U.S. PATENT DOCUMENTS 3,638,063 A 1/1972 Tachikawa et al.
4,926,089 A 5/1990 Moore
4,942,332 A 7/1990 Adler et al.
6,437,496 B1 * 8/2002 Kim et al. ..... 313/402
6,614,153 B2 * 9/2003 Bae et al. ..... 313/402

* cited by examiner

*Primary Examiner*—Joseph Williams
(74) *Attorney, Agent, or Firm*—Robert E. Bushnell, Esq.

(57) ABSTRACT

A mask assembly is formed to have a tension mask with a screen part for transmitting electron beams. The mask assembly is intended for use with a cathode ray tube. The screen part includes real slots, dummy slots, real bridges, dummy bridges, and strip parts. The screen part has a first portion and a second portion. The first portion has real bridges, dummy bridges, and dummy slots. The second portion has real bridges and real slots, but no dummy bridges and no dummy slots. The second portion of the screen part can be said to be associated with a center region that traditionally has degraded images due to undesired black lines. The second portion of the screen part is formed to have real bridges, real slots, no dummy bridges, and no dummy slots in order to provide improved clarity. The mask assembly has a tension mask which extends in either a longitudinal or transverse direction, and a mask frame for reinforcing the structural strength while maintaining an extended state of the tension mask.

20 Claims, 3 Drawing Sheets

CATHODE RAY TUBE HAVING MASK ASSEMBLY FOR DISPLAYING CLEARER IMAGES

CLAIM OF PRIORITY

This application makes reference to, incorporates the same herein, and claims all benefits accruing under 35 U.S.C. §119 from an application for *MASK ASSEMBLY FOR CATHODERAY TUBE* earlier filed in the Korean Industrial Property Office on Feb. 27, 2001 and there duly assigned Serial. No. 2001-9897 by that Office.

BACKGROUND OF THE INVENTION

1. Technical Field

The present invention relates to a mask assembly for a cathode ray tube having real bridges and dummy bridges, and more particularly to a mask assembly for a cathode ray tube in which real bridges are formed in bad view portions for improved clarity.

2. Related Art

In general, a cathode ray tube employed in a monitor of a computer and a television set is a display which forms images by exciting red (R), green (G), and blue (B) phosphors by landing three electron beams, which are emitted from an electron gun, onto the phosphors of a screen via electron beam apertures of a shadow mask.

A screen surface of a color cathode ray tube, which forms images as described above, is designed with a predetermined curvature considering deflection tracks of the electron beams which are deflected by a deflection yoke. The shadow mask is designed with a curvature corresponding to a curvature of an inner surface of the screen surface.

The shadow mask is thermally expanded by electron beams which cannot pass through the electron beam passing apertures. As a result of the thermal expansion, the shadow mask is expanded toward a panel, a doming phenomenon occurs due to a change of the landing positions of the electron beams, and phosphors of unintended colors are excited, causing the purity of color to be degraded.

In order to remove the above-described disadvantages, and to comply with the increased demand for larger and flatter display screens, U.S. Pat. No. 3,683,063 entitled "GRID STRUCTURE FOR COLOR PICTURE TUBES", and issued on Jan. 25, 1972 to Tachikawa et al., discloses a tension mask that is fixed to a mask frame under tension. The tension mask disclosed in Tachikawa '063 is an aperture grill type tension mask. In the tension mask of Tachikawa '063, a plurality of strips are separated from one another by a predetermined interval and supported by the mask frame under tension applied in one direction. In the shadow mask of Tachikawa '063, the thermal expansion generated during the operation of the cathode ray tube is absorbed by the applied tension in order to prevent the doming phenomenon. The strips, formed of thin steel with a thickness of 0.1 millimeters (mm), are not connected to proximate strips, but are supported by the mask frame at both end parts only so that the strips become vibrating even at a small impact, inducing the vibration of images. The mask of Tachikawa '063 has a disadvantage in that a weight of the mask frame must be increased in order to maintain the structural strength, since the tension applied to the strips is proportional to the thickness of the mask.

In order to remove the above-described disadvantages, a different tension mask is disclosed in U.S. Pat. No. 4,942,332 entitled "TIED SLIT MASK FOR COLOR CATHODE RAY TUBES", and issued on Jul. 17, 1990 to Adler et al. The tension mask of Adler '332 has a valid screen part that includes a plurality of strips which are separated by a predetermined interval from one another, and a plurality of slots formed by real bridges which connect the strips to one another, wherein a long side part of the mask is fixed to supporting members. The slots formed by the real bridges have a length of approximately 5.0 millimeters or more. The Adler '332 mask has a disadvantage in that black lines are clearly generated on the screen due to the shadows of the real bridges, even though the howling phenomenon generated by the vibration of the mask due to the external impact may be reduced by the real bridges.

In order to remove the above-described disadvantages, another tension mask is disclosed in U.S. Pat. No. 4,926,089 entitled "TIED SLIT FOIL SHADOW MASK WITH FALSE TIES", and issued on May 15, 1990 to Moore. In Moore '089, there is disclosed a tension mask in which the generation of the black lines is restrained by a plurality of dummy bridges provided on slots defined by the real bridges. The dummy bridges are formed in almost equal areas with the real bridges for generating similar black lines as generated by the real bridges, thereby preventing the black lines of the real bridges from being shown to viewers. The above tension mask is generally manufactured by photolithography. That is, a thin plate forming a mask is deposited with a photosensitive film at both surfaces, and the photosensitive films and the thin plate are etched in a predetermined pattern.

While the above-described efforts provide advantages related to cathode ray tubes, they do have some disadvantages as explained above, and they fail to adequately provide an efficient and convenient mask assembly for a cathode ray tube.

SUMMARY OF THE INVENTION

It is an object of the present invention to provide a mask assembly which does not have the above-described disadvantages.

It is a further object of the present invention to provide a cathode ray tube with an improved visibility. It is another object of the present invention to provide an improved cathode ray tube that displays clearer images.

The present invention is derived to resolve the above problems, and has an object of providing a cathode ray tube with improved visibility.

In order to achieve the above and other advantages and in accordance with the purpose of the present invention, as embodied and broadly described, a mask assembly for a cathode ray tube includes a tension mask having a valid screen part for transmitting electron beams, and extending in either a longitudinal or a transverse direction, and a mask frame for reinforcing the structural strength while maintaining the extended state of the tension mask, wherein the valid screen part includes slots, dummy slots and strip parts, the slots are provided in a predetermined area including the center of the valid screen part, and the dummy slots are provided in an area outside the slot area.

It is preferable that the predetermined area be formed symmetrically with respect to a horizontal central line H—H and a vertical central line V—V, which respectively pass through a center point of the valid screen part.

More specifically, the predetermined area is formed in the shape of a rectangle including the center point of the valid screen part, or concave in the middle section of the vertical central line V—V including the center point of the valid screen part, or convex in the middle section of a vertical central line V—V including the center point of the valid screen part, or the predetermined area may be formed in the vertical parts except the central part of the valid screen part.

If it is assumed that a whole horizontal length and a whole vertical length of the valid screen part are respectively x' and y' in plane coordinates, in which horizontal and vertical directions from a left lower peak of the valid screen part are defined respectively by an axis x and an axis y, and the predetermined area is formed of an inner space which is defined by straight or curve lines connecting six points $P_1$–$P_6$ in sequence, wherein in the six points, $P_1(x,y)=\{(x'/4\sim x'/3),0\}$, $P_2(x,y)=\{(2x'/3\sim 3x'/4),0\}$, $P_3(x,y)=\{(2x'/3\sim 3x'/4),y'/2\}$, $P_4(x,y)=\{(2x'/3\sim 3x'/4),y'\}$, $P_5(x,y)=\{(x'/4\sim x'/3),y'\}$, and $P_6(x,y)=\{(x'/4\sim x'/3),y'/2\}$.

The rectangular area is formed of an inner space which is defined by straight or curved lines connecting six points $P_1$–$P_6$ in sequence, wherein in the six points, $P_1(x,y)=(x'/4,0)$, $P_2(x,y)=(3x'/4,y'/4,0)$, $P_3(x,y)=(3x'/4,y'/2)$, $P_4(x,y)=(3x'/4,y')$, $P_5(x,y)=(x'/4,y')$, and $P_6(x,y)=(x'/4,y'/2)$.

The concave area is formed of an inner space which is defined by straight or curved lines connecting six points $P_1\sim P_6$ in sequence, wherein in the six points, $P_1(x,y)=(x'/4,0)$, $P_2(x,y)=(3x'/4,0)$, $P_3(x,y)=(2x'/3,y'/2)$, $P_4(x,y)=(3x'/4,y')$, $P_5(x,y)=(x'/4,y')$, and $P_6(x,y)=(x'/3,y'/2)$.

The convex area is formed of an inner space which is defined by straight or curved lines connecting six points $P_1\sim P_6$ in sequence, wherein in the six points, $P_1(x,y)=(x'/3,0)$, $P_2(x,y)=(2x'/3,0)$, $P_3(x,y)=(3x'/4,y'/2)$, $P_4(x,y)=(2x'/3,y')$, $P_5(x,y)=(x'/3,y')$, and $P_6(x,y)=(x'/4,y'/2)$.

The area formed in the only vertical part, except the central part of the valid screen part, is formed of an inner space which is defined by straight or curved lines connecting three points $P_1\sim P_3$ and an inner space which is defined by straight or curve lines connecting three points $P_4\sim P_6$, wherein $P_1(x,y)=(x'/4,0)$, $P_2(x,y)=(x'/2,y'/4)$, $P_3(x,y)=(3x'/4,0)$, $P_4(x,y)=(x'/4,y')$, $P_5(x,y)=(x'/2,3y'/4)$, and $P_6(x,y)=(3x'/4,y')$.

The real bridge provided to the outer area may be formed of a vertical width in the range of 0.8–1.2 times the vertical width of the real bridges provided in the predetermined area.

The real bridge provided in the predetermined area and the outer area may be respectively formed with variable vertical widths.

The slots provided in the predetermined area may be formed to have a constant value in a vertical pitch, wherein the dummy slots provided in the outer area may be formed with a vertical pitch in the range of 0.7–1.0 times the vertical pitch of the slots provided in the predetermined area.

Further, the slots and the dummy slots provided in both areas may be formed with variable values in the vertical pitch. The vertical width of the dummy bridges may be set in the range of 0.5–2.0 times the vertical width of the real bridges.

To achieve these and other objects in accordance with the principles of the present invention, as embodied and broadly described, the present invention provides an apparatus, comprising: a tension mask having a screen part transmitting electron beams, the screen part having a first area including a center region of the screen part, and having a second area distinguishable from the first area; and a mask frame being coupled to said tension mask and reinforcing structural strength of said tension mask while applying tension to said tension mask; the screen part including a plurality of real slots, dummy slots, and strip parts, the real slots being located in the first area, the dummy slots being located in the second area.

To achieve these and other objects in accordance with the principles of the present invention, as embodied and broadly described, the present invention provides a mask assembly for a cathode ray tube comprising: a tension mask having a screen part transmitting electron beams, the screen part having a first area including a center region of the screen part, and having a second area distinguishable from the first area; and a mask frame being coupled to said tension mask and reinforcing structural strength of said tension mask while applying tension to said tension mask; the screen part including a plurality of real slots, dummy slots, and strip parts, the real slots being located in the first area, the dummy slots being located in the second area; the first area including an upper part and a lower part, the upper part being spaced apart from the lower part, a center point at the center of the screen part being located between the upper and lower parts.

To achieve these and other objects in accordance with the principles of the present invention, as embodied and broadly described, the present invention provides a mask assembly for a cathode ray tube, comprising: a pair of supporting members; a pair of elastic members, each elastic member being disposed between and connected to said supporting members; and a mask being coupled to said supporting members and being tensioned by said elastic members, said mask having a valid screen part forming a plurality of beam-passing apertures, the screen part having a first area including a center region of the screen part, and having a second area distinguishable from the first area; the screen part including a plurality of real slots, dummy slots, and strip parts, the real slots being located only in the first area, the dummy slots being located only in the second area; the screen part being arranged to have a first edge region substantially parallel to an X axis, the first area being symmetrically formed around a first imaginary line parallel to the X axis, the first area being symmetrically formed around a second imaginary line perpendicular to the X axis.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
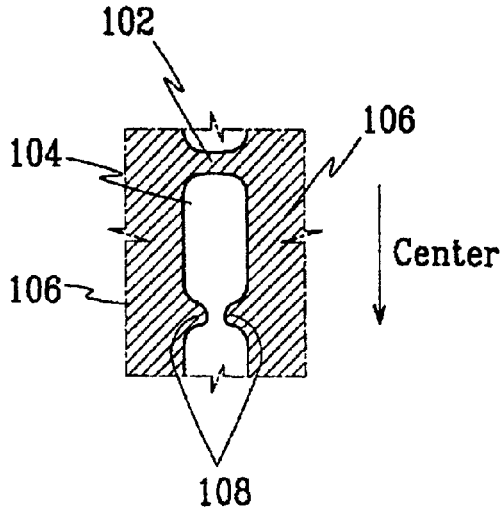
FIG. 1 is an expanded view of principal parts of a tension mask.

A tension mask, which has dummy slots formed by dummy bridges which are regularly disposed with the real bridges, has disadvantages as follows. Turn now to FIG. 1, which is an expanded view of principal parts of a tension mask. As shown in FIG. 1, when the mask is manufactured by etching a thin plate, a dummy bridge 108, which is provided in a slot 104 defined by a real bridge 102 and not connected to a proximate strip 106, is not in the structure of a rectangle but is spread radially toward a center of the mask, wherein such a shape of the dummy bridge 108 induces a difference of shadow areas between the dummy bridge 108 and the real bridge 102.

Therefore, due to the difference generated in the area ratio, the shadow of the dummy bridge 108 becomes smaller than that of the real bridge 102, so that the problem of the prior art having the real bridges only is not resolved and the black lines may be observed by the views clearly.

The black lines are generated over the whole screen in the positions of the real bridges regularly, but more largely in the center and vertical part of the screen, where the electron beams are not deflected right and left, and thereby the fine view is degraded due to the black lines in the upper and lower parts of the center.

The present invention will be explained in more detail with reference to the preferred embodiments in conjunction with the attached drawings. The present invention includes a mask assembly formed to have a tension mask with a screen part for transmitting electron beams. The mask assembly can be used with a cathode ray tube. The screen part includes real slots, dummy slots, real bridges, dummy bridges, and strip parts. The screen part has a first portion and a second portion. The first portion has real bridges, dummy bridges, and dummy slots. The second portion has real bridges and real slots, but no dummy bridges and no dummy slots. The second portion of the screen part can be said to be associated with a region of a screen of a cathode ray tube that traditionally is known for degraded images due to the undesired black lines described above. The second portion of the screen part, when it is formed in accordance with the principles of the present invention, can provide an improved clarity without the undesired black lines. The second portion of the screen part is formed to have real bridges, real slots, no dummy bridges, and no dummy slots, in order to provide an improved clarity and improved visibility. The mask assembly has a tension mask which extends in either a longitudinal or a transverse direction, and a mask frame for reinforcing the structural strength while maintaining an extended state of the tension mask.

Figure 2:
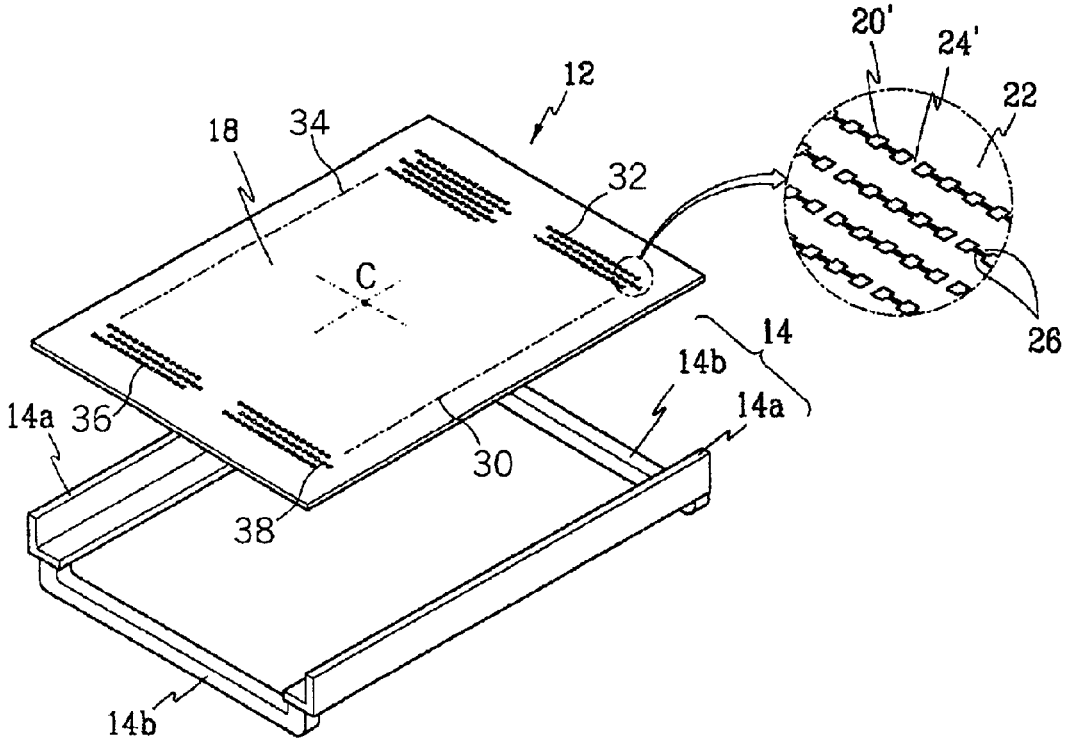
FIG. 2 is a perspective view of a disassembled mask assembly for a cathode ray tube, in accordance with the principles of the present invention.

Turn now to FIG. 2, which is a perspective view of a disassembled mask assembly for a cathode ray tube, in accordance with the principles of the present invention. As shown in FIG. 2, a mask assembly mounted on a panel (not shown) by a predetermined distance from a screen (not shown), includes a tension mask 12 serving as a color discrimination electrode, a mask frame 14 for supporting the tension mask 12, and a plurality of spring assemblies (not shown) for fixing the mask frame to the panel (not shown), wherein the mask frame 14 includes a pair of supporting members 14*a* disposed facing long side parts of the mask 12 which are to be applied with tension, and a pair of elastic members 14*b* for maintaining a predetermined distance between the supporting members 14*a*. The elastic members 14*b* cause the mask 12 to be tensioned.

The tension mask 12, extending in the vertical direction of a screen and fixed to the pair of supporting members 14*a*, is formed by etching thin aluminium killed (AK) steel or INVAR steel with a predetermined pattern, wherein a valid screen part 18 is formed on the tension mask 12 by the etching, and passes through electron beams emitted by an electron gun (not shown).

Figure 3:
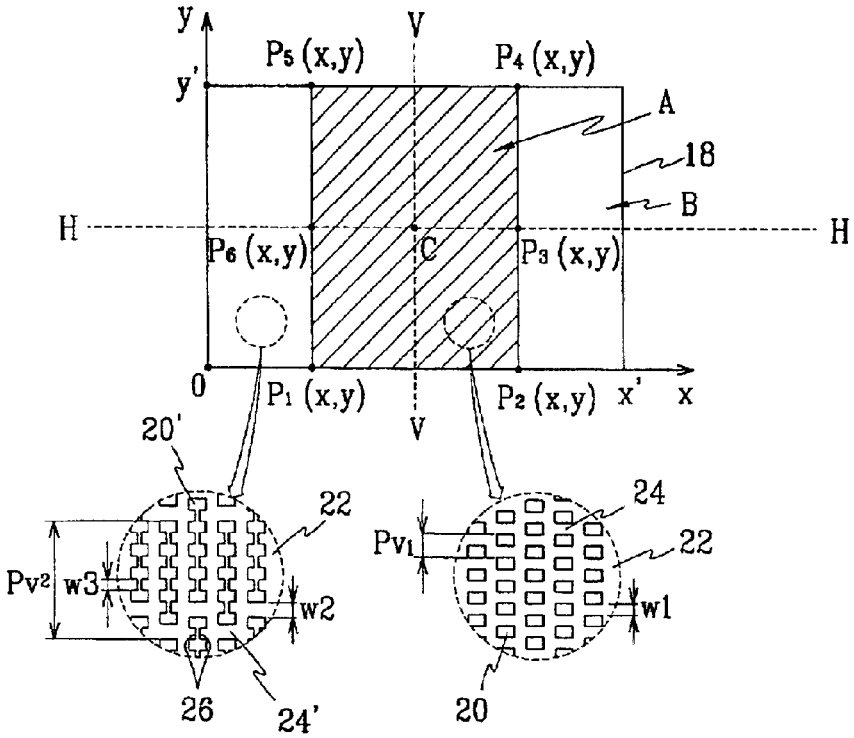
FIG. 3 is a plane view of a tension mask according to a first preferred embodiment, in accordance with the principles of the present invention.

With continued reference to FIG. 2, turn now to FIG. 3 which is a plane view of a tension mask according to a first preferred embodiment, in accordance with the principles of the present invention. Electron beams pass through the valid screen part 18 while traveling toward a screen surface of a cathode ray tube. Images are formed at the screen surface. As shown in FIGS. 2 and 3, the strips 22 are formed to block the electron beams, and to basically prevent the electron beams from passing through the valid screen part 18. However, the real slots 20 are different than the strips 22, because the real slots 20 are apertures that allow the electron beam to pass through the valid screen part 18. A real bridge 24 is a region that blocks the electron beam, similar to a strip 22. The real bridges 24 can be said to connect two adjacent strips 22, as shown in FIG. 3, for example. A dummy bridge 26 is a region that at least partly blocks the electron beam, and includes a narrow slot or aperture that separates two adjacent strips 22, as shown in FIGS. 2 and 3, for example. The dummy bridge 26 almost connects two adjacent strips 22. The dummy bridge 26 does not fully connect two adjacent strips 22 because of the narrow slot or aperture in the dummy bridge 26.

As shown in FIG. 2, the tension mask 12 has four edge regions, and the valid screen part 18 also has four edge regions. The four edge regions of the valid screen part 18 are labeled as 30, 32, 34, and 36. The four edge regions of the valid screen part 18 are shown to correspond in location roughly to the four edge regions of the tension mask 12. The edge regions 30 and 34 of the valid screen part 18 are adjacent to the supporting members 14*a*. The edge regions 32 and 36 of the valid screen part 18 are adjacent to the elastic members 14*b*.

As shown in FIG. 2, when the tension mask 12 is arranged so that the edge region 30 is the lowest edge region, the edge region 30 can be referred to as the bottom edge, and the edge region 36 can be referred to as a side edge. As shown in FIG. 3, the valid screen part 18 is arranged so that the bottom edge region 30 is substantially on the X axis and is substantially parallel to the X axis. As shown in FIG. 3, the valid screen part 18 is arranged so that the side edge region 36 is substantially on the Y axis and is substantially parallel to the Y axis. Thus, the left lower peak ○ shown in FIG. 3 can correspond to the corner region 38 shown in FIG. 2.

The valid screen part 18 includes a plurality of strips 22 separated from one another by a predetermined distance, slots 20 and dummy slots 20', a plurality of real bridges 24 and 24' for connecting proximate strips 22 to one another, and a plurality of dummy bridges 26 which are provided to the slots defined by the real bridges 24', but which are not connected to the proximate strips, as shown in FIG. 3. The slots 20 can be referred to as real slots 20, which are different from the dummy slots 20'. Accordingly, the slots 20 are formed by the strips 22 and real bridges 24, and the dummy slots 20' are formed by the strips 22, real bridges 24' and dummy bridges 26.

When manufacturing the mask by etching a thin plate, black lines are generated on the screen due to the difference between shadow areas of the dummy bridges and the real bridges as described above, wherein the black lines are generated more in the center and vertical parts of the screen where a right and left deflection amount of the electron beams is relatively small on the screen, thereby degrading the fine view.

In order to resolve the above problems, according to the present invention, the valid screen part 18 is divided into two different regions: inner area A and outer area B. The inner area A can be described as a predetermined area A. The outer area B is located outside of the predetermined area A. As shown in FIG. 3, the inner area A is shown as a rectangularly shaped area, and the outer area B is on both sides of the inner area A. The bridges in the inner area A are formed differently than the bridges in the outer area B.

When a viewer watches images formed by a cathode ray tube, the viewer might see some undesirable black lines, for the reasons discussed above. Thus, the viewer might see images that are flawed because of the undesirable black lines. The black lines might appear in some portions of the images, but not in other portions of the images. For example, the black lines might appear in inner areas of the images, but not in outer areas of the images.

The FIG. 3 shall now be discussed further. The predetermined area A, in which the view is not good due to the black lines, is disposed with the real bridges 24 to include the real slots 20 only. No dummy slots 20' are located in the predetermined area A, as shown in FIG. 3. The outer area B is disposed with the real bridges 24' and the dummy bridges 26 in the regular combination to include the dummy slots 20' only. No real slots 20 are located in the outer area B, as shown in FIG. 3.

The predetermined area A may be, as shown in FIG. 3, formed symmetrically in the shape of a rectangle with respect to a horizontal central line H—H and a vertical central line V—V which respectively pass a center point c of the valid screen part, wherein the center point c is included in the area A.

If it is presumed that the whole horizontal length and the whole vertical length of the valid screen part are respectively x' and y' in plane coordinates, in which horizontal and vertical directions from a left lower peak ○ of the valid screen part 18 are defined respectively by an axis x and an axis is y, the rectangular predetermined area A is formed of an inner space which is defined by straight lines connecting six points $P_1$~$P_6$ in sequence, wherein $P_1(x,y)=(x'/4,0)$, $P_2(x,y)=(3x'/4,0)$, $P_3(x,y)=(3x'/4,y'/2)$, $P_4(x,y)=(3x'/4,y')$, $P_5(x,y)=(x'/4,y')$, and $P_6(x,y)=(x'/4,y'/2)$. The left lower peak ○ shown in FIG. 3 can correspond to the corner region 38 shown in FIG. 2.

Figure 4:
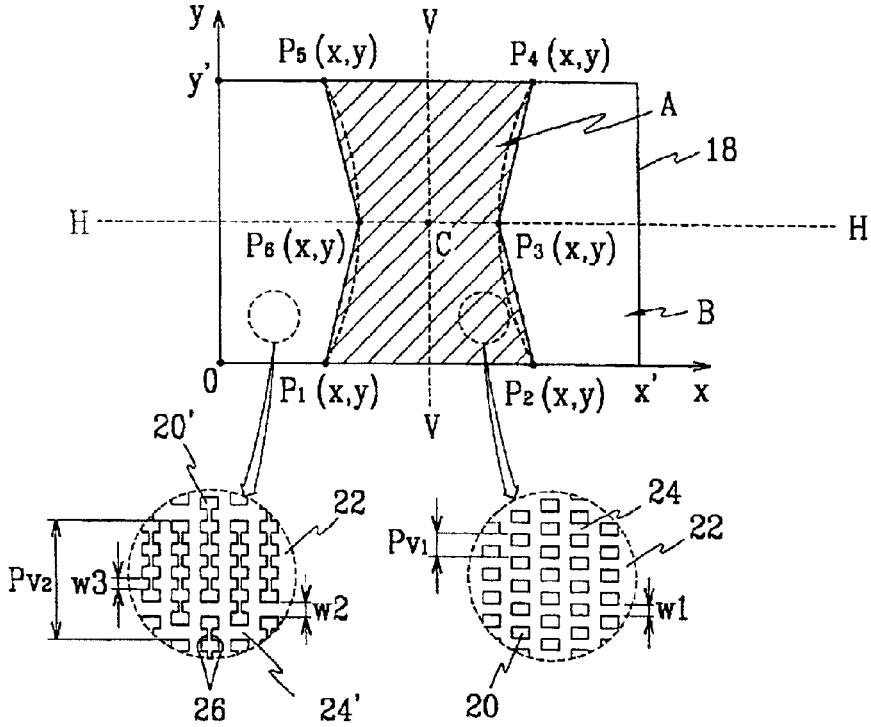
FIG. 4 is a plane view of a tension mask according to a second embodiment, in accordance with the principles of the present invention.

Turn now to FIG. 4, which is a plane view of a tension mask according to a second embodiment, in accordance with the principles of the present invention. The predetermined area A may be, as shown in FIG. 4, formed symmetrically with respect to the horizontal central line H—H and the vertical central line V—V which respectively pass a center point c of the valid screen part, wherein the center part of the vertical central line V—V may be formed concavely. As shown in FIG. 4, the inner area A can be formed to have an hour glass shape or a figure-8 shape, with concave sides.

Using the same plane coordinate system of FIG. 3, FIG. 4 can now be described further. As shown in FIG. 4, the concave area A maybe formed of an inner space which is defined by straight lines or curve lines (shown in dotted lines) connecting six points $P_1$~$P_6$ in sequence, wherein $P_1(x,y)=(x'/4,0)$, $P_2(x,y)=(3x'/4,0)$, $P_3(x,y)=(2x'/3,y'/2)$, $P_4(x,y)=(3x'/4,y')$, $P_5(x,y)=(x'/4,y')$, and $P_6(x,y)=(x'/3,y'/2)$.

Figure 5:
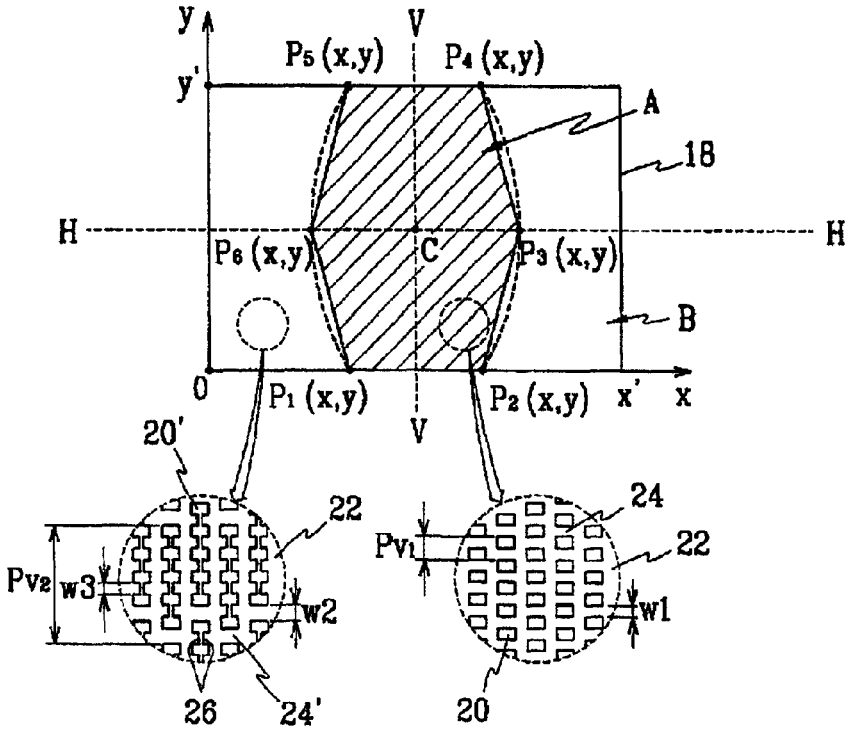
FIG. 5 is a plane view of a tension mask according to a third embodiment, in accordance with the principles of the present invention.

Turn now to FIG. 5, which is a plane view of a tension mask according to a third embodiment, in accordance with the principles of the present invention. The predetermined area A may be, as shown in FIG. 5, formed symmetrically with respect to the horizontal central line H—H and the vertical central line V—V, which respectively pass a center point c of the valid screen part, wherein the center part of the vertical central line V—V may be formed convexly. As shown in FIG. 5, the inner area A can be formed to have an hour glass shape or a figure-8 shape, with convex sides. The horizontal line H—H and the vertical line V—V can be referred to as imaginary lines.

Using the same plane coordinate system of FIG. 3, FIG. 5 can now be described further. As shown in FIG. 5, the predetermined area A may be formed of an inner space which is defined by straight lines or curve lines (shown in dotted lines) connecting six points $P_1$~$P_6$ in sequence, wherein $P_1(x,y)=(x'/3,0)$, $P_2(x,y)=(2x'/3,0)$, $P_3(x,y)=(3x'/4,y'/2)$, $P_4(x,y)=(2x'/3,y')$, $P_5(x,y)=(x'/3,y')$, and $P_6(x,y)=(x'/4,y'/2)$.

Figure 6:
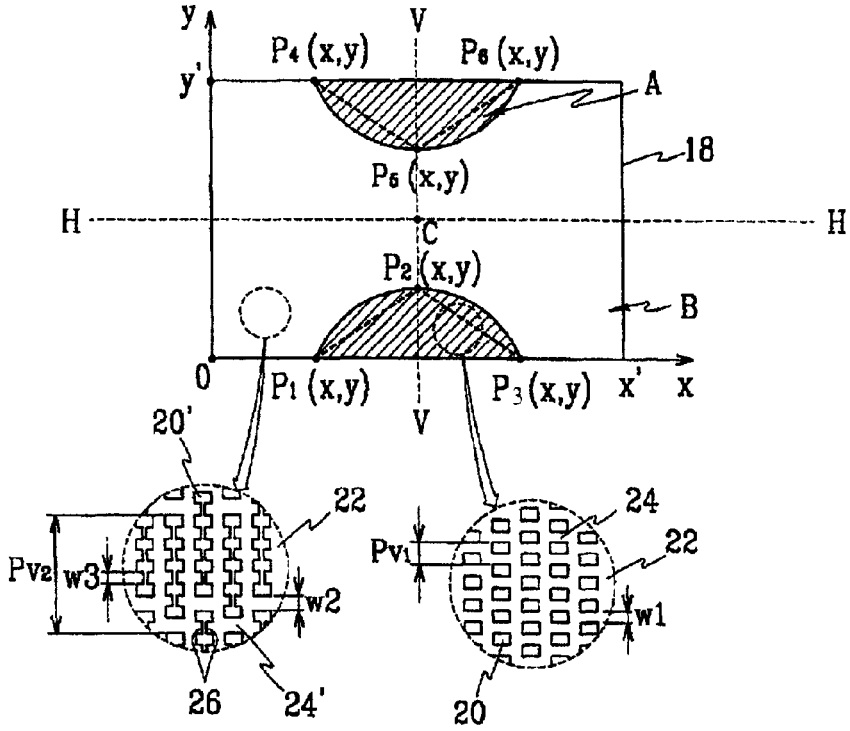
FIG. 6 is a plane view of a tension mask according to a fourth embodiment, in accordance with the principles of the present invention.

Turn now to FIG. 6, which is a plane view of a tension mask according to a fourth embodiment, in accordance with the principles of the present invention. The predetermined area A may be, as shown in FIG. 6, formed only in the vertical parts except the central part of the valid screen part 18.

Using the same plane coordinate system of FIG. 3, FIG. 6 can now be described further. As shown in FIG. 6, the areas A may be formed of an inner space which is defined by straight lines (shown in dotted lines) or curved lines connecting three points $P_1$~$P_3$ in sequence, and an inner space defined by straight lines (shown in dotted lines) or curved lines connecting three points $P_4$~$P_6$ in sequence in the same plane coordinates of the embodiments as shown in FIG. 3 to FIG. 5, wherein $P_1(x,y)=(x'/4,0)$, $P_2(x,y)=(x'/2,y'/4)$, $P_3(x,y)=(3x'/4,0)$, $P_4(x,y)=(x'/4,y')$, $P_5(x,y)=(x'/2,3y'/4)$, and $P_6(x,y)=(3x'/4,y')$. As shown in FIG. 6, the inner area A can be in the form of segregated sub-parts.

Regarding FIG. 6, the line connecting points $P_1$ and $P_2$ can be straight or curved. Regarding FIG. 6, the line connecting points $P_2$ and $P_3$ can be straight or curved. Regarding FIG. 6, the line connecting points $P_1$ and $P_3$ can be straight or curved. Regarding FIG. 6, the line connecting points $P_4$ and $P_5$ can be straight or curved. Regarding FIG. 6, the line connecting points $P_5$ and $P_6$ can be straight or curved. Regarding FIG. 6, the line connecting points $P_4$ and $P_6$ can be straight or curved.

As shown in FIGS. 3–6, in the inner area A, the real bridges 24 have a vertical width W1, and the real slots 20 have a vertical pitch PV1. As shown in FIGS. 3 to 6, in the outer area B, the real bridges 24' have a vertical width W2, the dummy bridges 26 have a vertical width W3, and the dummy slots 20' have a vertical pitch PV2.

In the preferred embodiments as shown in FIGS. 3 to 6, the real bridges 24 in the predetermined area A may be formed with a uniform vertical width $W_1$ that is, for example, 35 to 40 micrometers ($\mu$m) for an industrial cathode ray tube, or 60 to 80 micrometers for a domestic cathode ray tube. In this case, the real bridges 24' of the outer area B are formed with a vertical width $W_2$ in the range of 0.8 to 1.2 times the vertical width $W_1$ of the real bridges 24 of the predetermined area A, and the dummy bridges 26 in the outer area B may be formed with a vertical width $W_3$ in the range of 0.5 to 2.0 times the vertical width $W_1$ of the real bridges 24. Thus, $W_2$ is in the range of being less than or equal to 1.2 $W_1$, and being more than or equal to 0.8 $W_1$, and $W_3$ is in the range of being less than or equal to 2 $W_1$, and being more than or equal to 0.5 $W_1$.

Alternatively, it is possible to form the real bridges 24 and 24' provided in the areas A and B with variable vertical widths. In other words, the principles of the present invention do not require that the real bridges 24 all have a uniform vertical width $W_1$, and do not require that the real bridges 24' all have a uniform vertical width $W_2$.

In the preferred embodiments as shown in FIGS. 3 to 6, the slots 20 in the predetermined area A may be formed with a uniform vertical pitch $PV_1$, that is, for example, 0.3 to 0.4 millimeters (mm) for an industrial cathode ray tube, or 0.5 to 1.0 millimeters for a domestic cathode ray tube. In this case, the dummy slots 20' in the outer area B are formed with a vertical pitch $PV_2$ in the range of 0.7 to 1.0 times the vertical pitch $PV_1$ of the slots 20 in the inner area A, in consideration of Moire, margins and luminance. Thus, $PV_2$ is in the range of being less than or equal to $PV_1$ and being more than or equal to 0.7 $PV_1$.

Alternatively, it is possible to form the real slots 20 and dummy slots 20' with variable vertical pitches. In other words, the principles of the present invention do not require that the real slots 20 all have a uniform vertical pitch $PV_1$, and do not require that the dummy slots 20' all have a uniform vertical pitch $PV_2$.

If it is assumed that a whole horizontal length and a whole vertical length of the valid screen part are respectively x' and y' in plane coordinates, in which horizontal and vertical directions from a left lower peak of the valid screen part are defined respectively by an axis x and an axis y, the predetermined area is formed of an inner space which is defined by straight or curved lines connecting six points $P_1$–$P_6$ in sequence, wherein in the six points, $P_1(x,y)=\{(x'/4x'/3),0\}$, $P_2(x,y)=\{(2x'/3\sim3x'/4),0\}$, $P_3(x,y)=\{(2x'/3\sim3x'/4),y'/2\}$, $P_4(x,y)=\{(2x'/3\sim3x'/4),y'\}$, $P_5(x,y)=\{(x'/4\sim x'/3),y'\}$, and $P_6(x,y)=\{(x'/4\sim x'/3),y'/2\}$. Thus, in accordance with the principles of the present invention, each of the six points $P_1$ to $P_6$ can be placed within a defined range of locations. The point $P_1$ can be placed such that the y coordinate is 0, and the x coordinate is anywhere from x'/4 to x'/3, inclusive. The point $P_2$ can be placed such that the y coordinate is 0, and the x coordinate is anywhere from 2x'/3 to 3x'/4, inclusive. The point $P_3$ can be placed such that the y coordinate is y'/2, and the x coordinate is anywhere from 2x'/3 to 3x'/4, inclusive. The point $P_4$ be placed such that the y coordinate is y', and the x coordinate is anywhere from 2x'/3 to 3x'/4, inclusive. The point $P_5$ can be placed such that the y coordinate is y', and the x coordinate is anywhere from x'/4 to x'/3, inclusive. The point $P_6$ can be placed such that the y coordinate is y'/2, and the x coordinate is anywhere from x'/4 to x'/3, inclusive. Therefore, in accordance with the foregoing ranges for the six points $P_1$ to $P_6$, the enclosed area can have a rectangle shape, a concave shape, or a convex shape.

As described hereinabove, according to the present invention, the degradation of the fine view may be prevented by forming only the real bridges in the portions in which the fine view is weakened due to the generation of the black lines.

Therefore, the tension masks according to the present invention as described hereinabove, is provided with the real bridges in the weak portions in which the black lines are apt to be generated, so that the degradation of the fine view may be essentially resolved without any influence of the etching, thereby improving the definition of the screen.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An apparatus, comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the screen part having a first edge region substantially parallel to an X axis, the first area being symmetrically formed around a first imaginary line parallel to the X axis, the first area being symmetrically formed around a second imaginary line perpendicular to the X axis;

the first area being concavely shaped in a middle region of the second imaginary line.

2. The apparatus of claim 1, the real slots in the first area being formed by a plurality of real bridges in the first area, each real bridge connecting adjacent ones of the strip parts to each other, the dummy slots in the second area being formed by a plurality of dummy bridges in the second area.

3. The apparatus of claim 2, the first area being symmetrically formed around a first axis and being symmetrically formed around a second axis perpendicular to the first axis.

4. The apparatus of claim 3, the first and second axes passing through a center point at a center of the screen part.

5. The apparatus of claim 1, the first and second imaginary lines being straight lines passing through a center point at a center of the screen part.

6. An apparatus, comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the screen part having a first edge region substantially parallel to an X axis, the first area being symmetrically formed around a first imaginary line parallel to the X axis, the first area being symmetrically formed around a second imaginary line perpendicular to the X axis;

the screen part having the first edge region on the X axis and a second edge region on a Y axis perpendicular to the X axis, the X and Y axes crossing each other at a corner region of the screen part, the first edge region having a length x' and the second edge region having a length y', the first area being bordered by six lines connecting six points $P_1$ to $P_6$ in sequence, the six points corresponding to coordinates on the X and Y axes and being $P_1(x,y)=(x'/4,0)$, $P_2(x,y)=(3x'/4,0)$, $P_3(x,y)=(3x'/4,y'/2)$, $P_4(x,y)=(3x'/4,y')$, $P_5(x,y)=(x'/4,y')$, $P_6(x,y)=(x'/4,y'/2)$, the six lines including at least two straight lines and up to four curved lines.

7. An apparatus, comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the screen part having a first edge region substantially parallel to an X axis, the first area being symmetrically formed around a first imaginary line parallel to the X axis, the first area being symmetrically formed around a second imaginary line perpendicular to the X axis;

the screen part having the first edge region on the X axis and a second edge region on a Y axis perpendicular to the X axis, the X and Y axes crossing each other at a corner region of the screen part, the first edge region having a length x' and the second edge region having a length y', the first area being bordered by six lines connecting six points $P_1$ to $P_6$ in sequence, the six points corresponding to coordinates on the X and Y axes and being $P_1(x,y)=(x'/4,0)$, $P_2(x,y)=(3x'/4,0)$, $P_3(x,y)=(2x'/3,y'/2)$, $P_4(x,y)=(3x'/4,y')$, $P_5(x,y)=(x'/4,y')$, $P_6(x,y)=(x'/3,y'/2)$ the six lines including at least two straight lines and up to four curved lines.

8. An apparatus, comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the screen part having a first edge region substantially parallel to an X axis, the first area being symmetrically formed around a first imaginary line parallel to the X axis, the first area being symmetrically formed around a second imaginary line perpendicular to the X axis;

the screen part having the first edge region on the X axis and a second edge region on a Y axis perpendicular to the X axis, the X and Y axes crossing each other at a corner region of the screen part, the first edge region having a length x' and the second edge region having a length y', the first area being bordered by six lines connecting six points $P_1$ to $P_6$ in sequence, the six points corresponding to coordinates on the X and Y axes and being $P_1(x,y)=(x'/3,0)$, $P_2(x,y)=(2x'/3,0)$, $P_3(x,y)=(3x'/4,y'/2)$, $P_4(x,y)=(2x'/3,y')$, $P_5(x,y)=(x'/3,y')$, $P_6(x,y)=(x'/4,y'/2)$, the six lines including at least two straight lines and up to four curved lines.

9. An apparatus, comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the screen part having a first edge region substantially parallel to an X axis, the first area being symmetrically formed around a first imaginary line parallel to the X axis, the first area being symmetrically formed around a second imaginary line perpendicular to the X axis;

the screen part having the first edge region on the X axis and a second edge region on a Y axis perpendicular to the X axis, the X and Y axes crossing each other at a corner region of the screen part, the first edge region having a length x' and the second edge region having is a length y', the first area being bordered by lines connecting six points $P_1$ to $P_6$ in sequence, each of the six points $P_1$ to $P_6$ being located within a respective range, the locations of the six points corresponding to coordinates on the X and Y axes and being $P_1(x,y)=(x'/4 \text{ to } x'/3,0)$, $P_2(x,y)=(2x'/3 \text{ to } 3x'/4,0)$, $P_3(x,y)=(2x'/3 \text{ to } 3x'/4,y'/2)$, $P_4(x,y)=(2x'/3 \text{ to } 3x'/4,y')$, $P_5(x,y)=(x'/4 \text{ to } x'/3,y')$, $P_6(x,y)=(x'/4 \text{ to } x'/3,y'/2)$.

10. An apparatus, comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the screen part having a first edge region substantially parallel to an X axis, the first area being symmetrically formed around a first imaginary line parallel to the X axis, the first area being symmetrically formed around a second imaginary line perpendicular to the X axis;

the first area being convexly shaped in a middle region of the second imaginary line.

11. The apparatus of claim 10, the real slots in the first area being formed by a plurality of real bridges in the first area, each real bridge connecting adjacent ones of the strip parts to each other, the dummy slots in the second area being formed by a plurality of dummy bridges in the second area.

12. The apparatus of claim 11, the first area being symmetrically formed around a first axis and being symmetrically formed around a second axis perpendicular to the first axis.

13. The apparatus of claim 12, the first and second axes passing through a center point at a center of the screen part.

14. The apparatus of claim 11, the first and second imaginary lines being straight lines passing through a center point at a center of the screen part.

15. A mask assembly for a cathode ray tube comprising:

a tension mask having a screen part for transmitting electron beams, the screen part having a first area including a center region of the screen part, and having a second area distinguishable from the first area and not including the center region of the screen part; and a mask frame coupled to said tension mask for reinforcing structural strength of said tension mask while applying tension to said tension mask;

the screen part including a plurality of real slots, dummy slots and strip parts, the real slots being located in the first area, the dummy slots being located in the second area;

the first area including an upper part and a lower part, the upper part being spaced apart from the lower part, a center point at the center of the screen part being located between the upper and lower parts;

the screen part having a first edge region substantially parallel to an X axis, the first area being symmetrically formed around a first imaginary line parallel to the X axis, the first area being symmetrically formed around a second imaginary line perpendicular to the X axis;

the screen part having the first edge region on the X axis and a second edge region on a Y axis perpendicular to the X axis, the X and Y axes crossing each other at a corner region of the screen part, the first edge region having a length x' and the second edge region having a length y', the lower part being bordered by three lines connecting three points $P_1$ to $P_3$ in sequence, the upper part being bordered by three lines connecting three points $P_4$ to $P_6$ in sequence, the six points $P_1$ to $P_6$ corresponding to coordinates on the X and Y axes and being $P_1(x,y)=(x'/4,0)$, $P_2(x,y)=(x'/2,y'/4)$, $P_3(x,y)=(3x'/4,0)$, $P_4(x,y)=(x'/4,y')$, $P_5(x,y)=(x'/2,3y'/4)$, $P_6(x,y)=(3x'/4,y')$.

16. The assembly of claim 15, the real slots in the first area being formed by a plurality of real bridges in the first area, each real bridge connecting adjacent ones of the strip parts to each other, the dummy slots in the second area being formed by a plurality of dummy bridges in the second area.

17. A mask assembly for a cathode ray tube, comprising:

a pair of supporting members;

a pair of elastic members, each elastic member being disposed between and connected to said supporting members; and a mask coupled to said supporting members and being tensioned by said elastic members, said mask having a valid screen part forming a plurality of beam-passing apertures, the screen part having a first area including a center region of the screen part, and having a second area distinguishable from the first area and not including the center region of the screen part;

the screen part including a plurality of real slots, dummy slots and strip parts, the real slots being located only in the first area, the dummy slots being located only in the second area;

the screen part having a first edge region substantially parallel to an X axis, the first area being symmetrically formed around a first imaginary line parallel to the X axis, the first area being symmetrically formed around a second imaginary line perpendicular to the X axis;

the first area being concavely shaped in a middle region of the second imaginary line.

18. The assembly of claim 17, the first area being formed in a rectangular shape.

19. A mask assembly for a cathode ray tube, comprising:

a pair of supporting members;

a pair of elastic members, each elastic member being disposed between and connected to said supporting members; and a mask coupled to said supporting members and being tensioned by said elastic members, said mask having a valid screen part forming a plurality of beam-passing apertures, the screen part having a first area including a center region of the screen part, and having a second area distinguishable from the first area and not including the center region of the screen part;

the screen part including a plurality of real slots, dummy slots and strip parts, the real slots being located only in the first area, the dummy slots being located only in the second area;

the screen part having a first edge region substantially parallel to an X axis, the first area being symmetrically formed around a first imaginary line parallel to the X axis, the first area being symmetrically formed around a second imaginary line perpendicular to the X axis;

the first area being convexly shaped in a middle region of the second imaginary line.

20. The assembly of claim 19, the first area being formed in a rectangular shape.

* * * * *